United States Patent [19]

Atherton et al.

[11] 4,058,174

[45] Nov. 15, 1977

[54] MOTOR GRADER WITH BLADE SUPPORT AND BEARING ASSEMBLY

[75] Inventors: Robert Allan Atherton, Chillicothe; Carroll Richard Cole, Decatur, both of Ill.

[73] Assignee: Caterpillar Tractor Co., Peoria, Ill.

[21] Appl. No.: 696,097

[22] Filed: June 14, 1976

[51] Int. Cl.[2] ..... E02F 3/76

[52] U.S. Cl. ..... 172/781; 172/741; 172/795

[58] Field of Search ..... 172/272, 273, 274, 275, 172/305, 476, 507, 667, 673, 719, 741, 743, 747, 767, 781, 782, 789, 791, 792, 793, 795, 796, 797; 214/138 C, 145 A; 280/456 R, 460 R, 461 R; 403/110

[56] References Cited

U.S. PATENT DOCUMENTS

| | | | |
|---|---|---|---|
| 2,799,099 | 7/1957 | Leliter | 172/667 |
| 3,117,685 | 1/1964 | Davis | 214/138 C |
| 3,463,243 | 8/1969 | Fisher | 172/781 |
| 3,465,829 | 9/1969 | Fisher et al. | 172/743 |
| 3,728,768 | 4/1973 | Mori | 172/741 X |

*Primary Examiner*—Richard T. Stouffer

*Attorney, Agent, or Firm*—Wegner, Stellman, McCord, Wiles & Wood

[57] ABSTRACT

An improved support and bearing for mounting the grader blade assembly of a motor grader on the depending support arms of the motor grader circle. Upright bearing housings are mounted on the arms and positioned forward thereof. Each housing has a forwardly open upper jaw and a forwardly open jaw the interiors of which are lined with anti-friction wear strips, and the blade assembly support rails are slidable in the wear strips, the latter being retained by detachable side plates on the housings. One of the lower wear strips is adjustable to maintain a snug sliding fit between the lower rail and all the wear strips in the lower jaws. The wear strips for the upper jaws are mounted in carriers that are vertically movable in the jaws to accommodate lack of parallelism in the support rails.

11 Claims, 10 Drawing Figures

Fig-1-
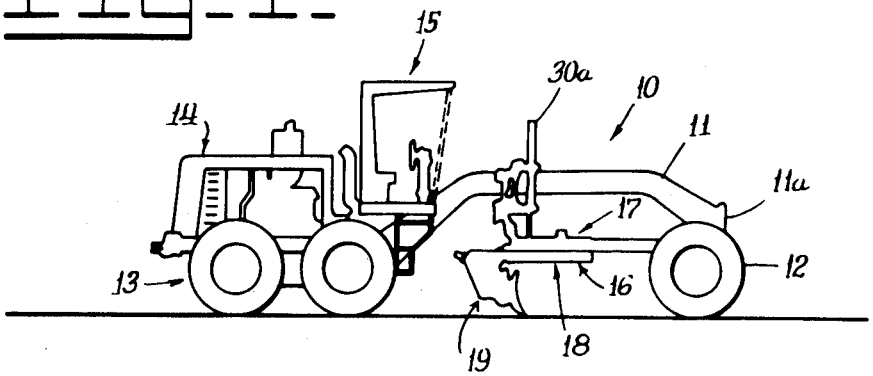
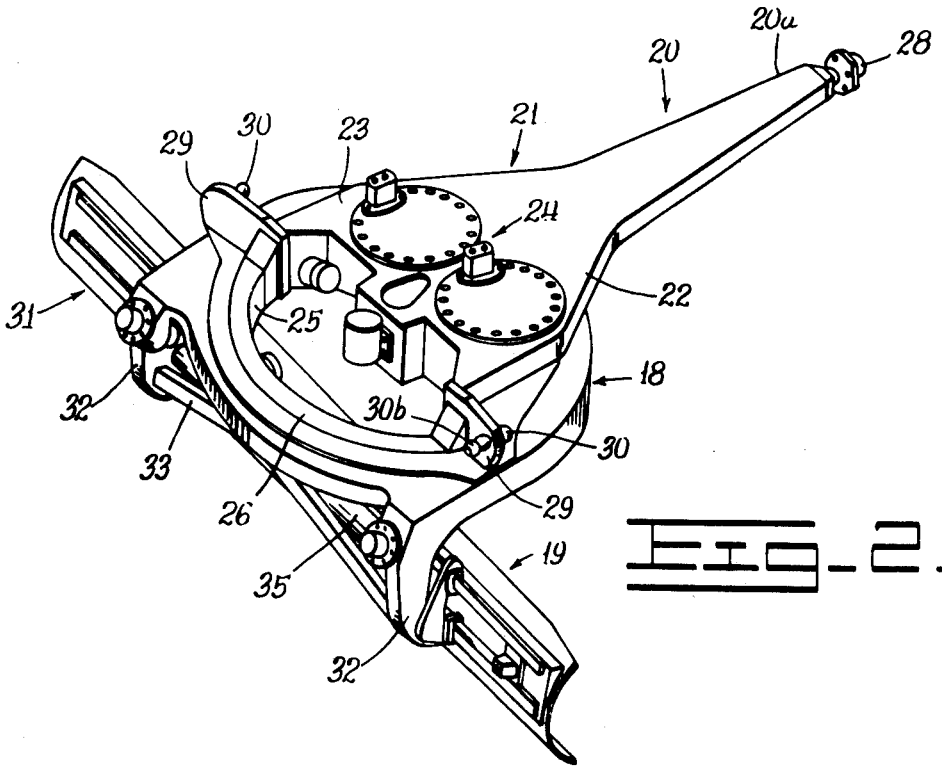
Fig-2-

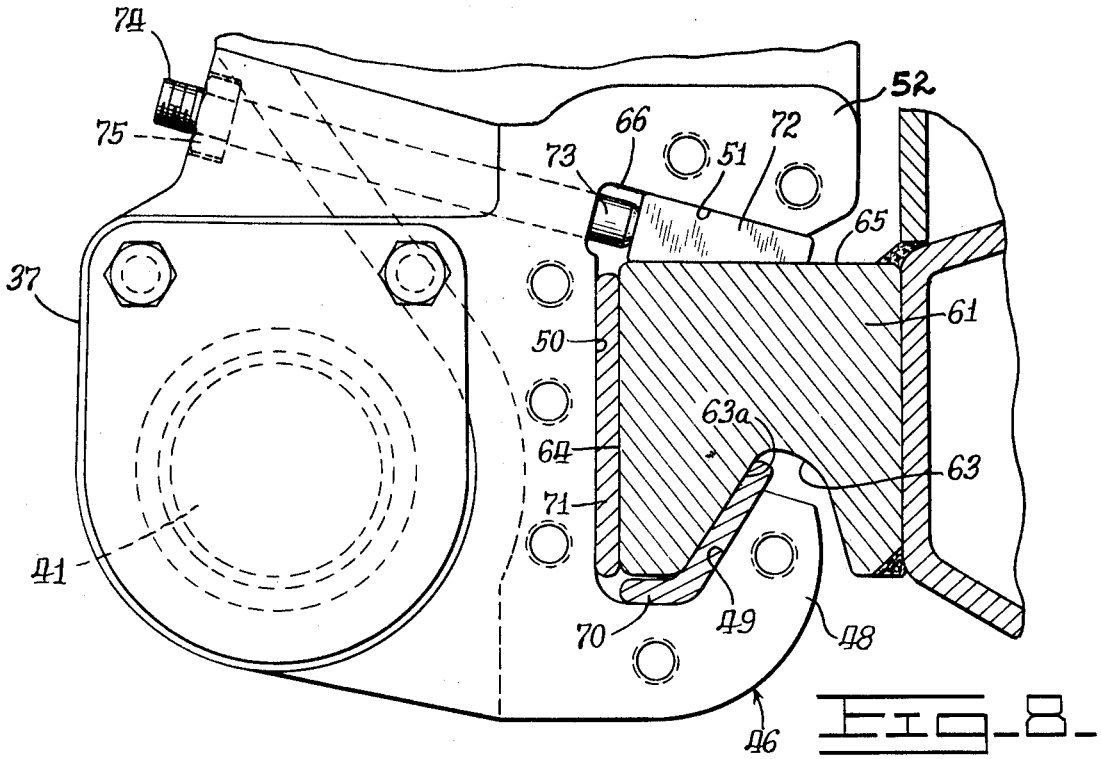
Fig-8-
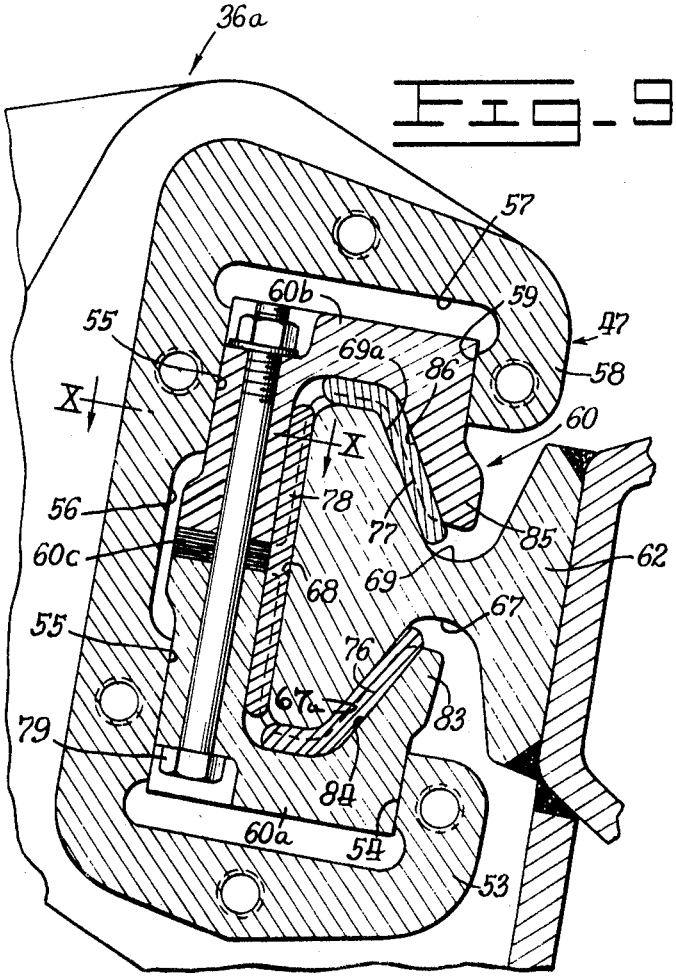
Fig-9-
Fig-10-
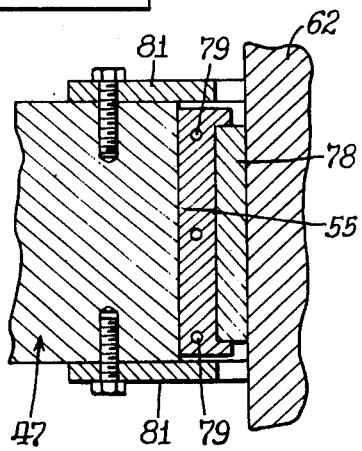

MOTOR GRADER WITH BLADE SUPPORT AND BEARING ASSEMBLY

CROSS REFERENCE TO RELATED APPLICATIONS

Details of the draw bar structure and of the circle mounting bar and circle assembly which are illustrated and described generally in this application are described in detail and claimed in copending U.S. patent applications of Carroll Richard Cole, Ser. No. 661,880, filed Feb. 27, 1976 and Ser. No. 663,594, filed Mar. 3, 1976 now U.S. Pat. No. 4,015,669, issued Apr. 5, 1977.

The blade structure which is illustrated and described generally in this application is described in detail and claimed in copending U.S. patent application of Carroll Richard Cole Ser. No. 696,161, filed June 14, 1976.

The blade mounting and the interrelationship between said mounting and the blade which is disclosed in this application is disclosed and claimed in copending U.S. patent application of Carroll Richard Cole, Ser. No. 696,163, filed June 14, 1976.

BACKGROUND OF THE INVENTION

Motor graders have a longitudinal main frame which has a dirigible wheel assembly at its forward end, an operator's cab at its rearward end portion, and a traction chassis for the motor and power train behind the cab. The motor grader blade is suspended from the main frame by means of a circle draw bar and a circle. The circle draw bar has its front end connected to the front of the main frame by a ball and socket connection, while the rearward portion of the circle draw bar is suspended from the main frame by hydraulic cylinder and piston means which permit the draw bar to swing in a vertical plane about its front end.

The circle is mounted on the rearward portion of the circle draw bar for rotation about a vertical axis, and there is a driving interconnection between a motor on the circle draw bar and a ring gear on the circle to effect such rotary motion of the circle.

The grader blade is mounted upon the circle so that rotation of the circle changes the angle of the blade with reference to the path of travel of the grader, while swinging the circle draw bar in a vertical plane about its forward end changes the vertical position of the grader blade with reference to the ground.

In addition, the grader blade is mounted on a horizontal axis so that it may be tipped with respect to the circle by hydraulic cylinder and piston means to change the angle of attack of the blade and it may also be shifted endwise in its mounting.

U.S. Pat. Nos. 2,799,099, 3,463,243 and 3,465,829 disclose typical prior art structures for mounting a motor grader blade assembly on the support arms of the circle for tilting movement and for endwise sliding movement.

SUMMARY OF THE INVENTION

The principal object of the present invention is to provide an improved support and bearing means for mounting the grader blade assembly of a motor grader on the support arms of the motor grader circle.

Another object of the invention is to provide a structure in which housings that have forwardly open upper and lower jaws to receive the upper and lower support rails of a motor grader blade assembly are provided with replaceable anti-friction wear strips in which the support bars are slidable endwise, with the wear strips being held in place by sideplates which fit around the support rails.

Yet another object of the invention is to provide a structure in which one of the wear strips that bears upon the lower support rail is adjustable, so that as wear causes looseness in the mounting of the support rail the looseness can be eliminated by moving the adjustable wear strip.

Still another object of the invention is to provide a structure in which anti-friction wear strips associated with the upper support rail are mounted in a wear strip carrier that has two adjustable parts to assure a close sliding fit between wear strips held in the carrier and the upper support rail, and in which the carrier is vertically slidable in the upper jaw so as to compensate for minor lack of parallelism between the two support rails of the grader blade assembly.

Yet another object of the invention is to provide a structure in which very wide wear strips effectively envelope the support rails to put low unit bearing pressure on the strips, thus permitting the use of plastic strips.

THE DRAWINGS

FIG. 1 is a side elevational view of a motor grader embodying the invention;

FIG. 2 is a perspective view of a subassembly consisting of a circle mounting bar, a circle, and a grader blade assembly and improved grader blade support and bearing means which embodies the present invention;

FIG. 8 is an enlarged fragmentary view of the lower portion of FIG. 6;

FIG. 9 is an enlarged fragmentary view of the upper part of FIG. 6; and

FIG. 10 is a fragmentary transverse sectional view on a reduced scale taken substantially as indicated along the line X—X of FIG. 9.

DETAILED DESCRIPTION OF THE INVENTION

Figure 3:
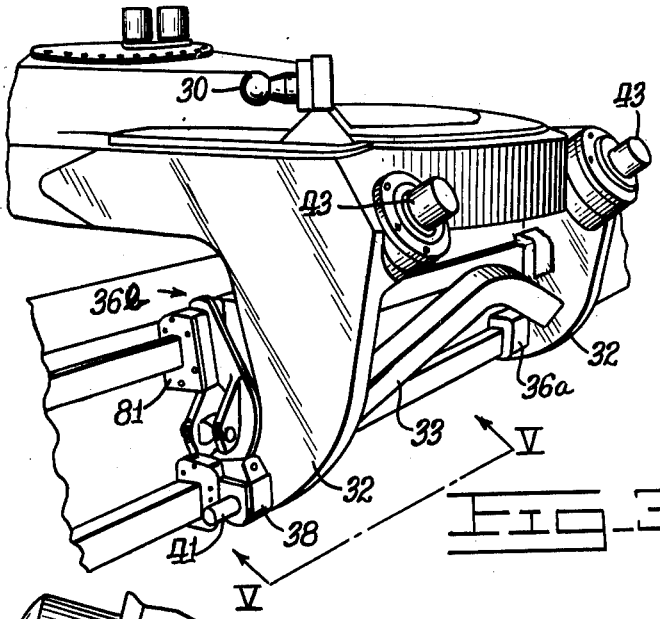
FIG. 3 is a fragmentary perspective view on an enlarged scale taken from the side opposite FIG. 2.

Referring first to FIG. 1 of the drawings, a motor grader, indicated generally at 10, includes a longitudinal main frame 11 the front end 11*a* of which is supported upon a dirigible front wheel assembly 12, and the rear end of which constitutes part of a traction chassis, indicated generally at 13, on which is mounted a power plant, indicated generally at 14. An operator's cab, indicated generally at 15, is on the rear portion of the main frame, forward of the traction chassis. A grader blade subassembly, indicated generally at 16, consists generally of a circle mounting bar, indicated generally at 17, which in the illustrated apparatus is a draw bar; a circle structure, indicated generally at 18; and a grader blade and blade mounting, indicated generally at 19.

The circle draw bar 17 is best seen in FIG. 2 to include a forward beam, indicated generally at 20, and a rearward circle carrying structure, indicated generally at 21, the forward part 22 of which is integral with the rear end of the beam 20. Behind the part 22 of the carrying structure said carrying portion has a section 23 the depth of which is great enough that it forms a housing extending below the circle 18. The housing section 23 receives drive means, indicated generally at 24. The housing section 23 of the circle draw bar merges into a nearly semi-annular upright wall 25 which is part of an internal housing for the circle 18, and integral with the wall 25 is a horizontal top wall 26.

The subassembly 16 is mounted under the main frame 11 by means of a front mounting element and rear mounting elements which engage with cooperating elements carried upon the main frame. At the front end 20*a* of the circle draw bar is a ball 28 which forms part of a ball and socket connection (not shown) by means of which the front of the circle draw bar is connected for universal movement on the front end 11*a* of the main frame. At the back end of the housing section 23 of the rearward circle draw bar portion 21 is a pair of aligned, laterally extending upright plates 29 which are provided with balls 30 that make ball and socket connections with fittings (not shown) on the lower ends of a pair of hydraulic cylinder and piston units 30*a* which are carried upon the main frame 11. Thus, operation of the hydraulic cylinder units 30*a* swings the circle draw bar 17 about the ball and socket connection including the ball 28, which in this respect provides a horizontal pivot axis. A ball 30*b* on one of the webs 29 provides for a ball and socket connection with a side-shift cylinder (not shown) which shifts the draw bar sideways, with the ball 28 providing a vertical pivot axis.

Referring now particularly to FIGS. 3 to 7, the grader blade and blade mounting 19 includes a grader blade assembly, indicated generally at 31, which is carried in blade support arms 32 that are integral with the rear portion of circle structure 18 and that are connected by a hollow square reinforcing beam 33. A bearing housing structure, indicated generally at 34, consists of a transverse hollow structural member 35 which has substantially upright bearing housings, indicated generally at 36*a* and 36*b*, at its two ends. The bearing housings are essentially mirror images of one another, but are not identical.

Figure 5:
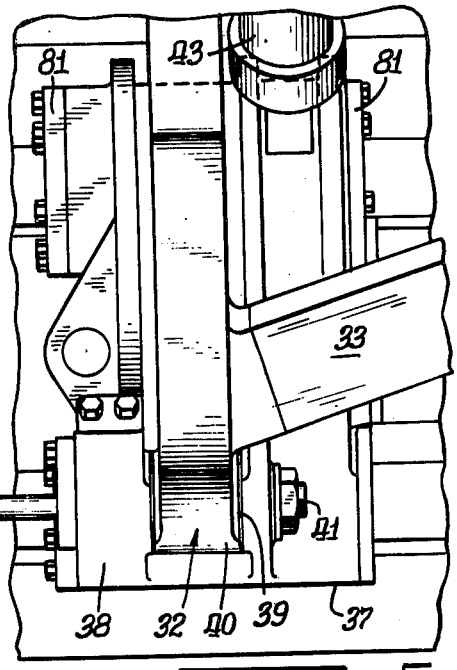
FIG. 5 is a fragmentary rear elevational view on a further enlarged scale taken substantially as indicated along the line V—V of FIG. 3.
Figure 6:
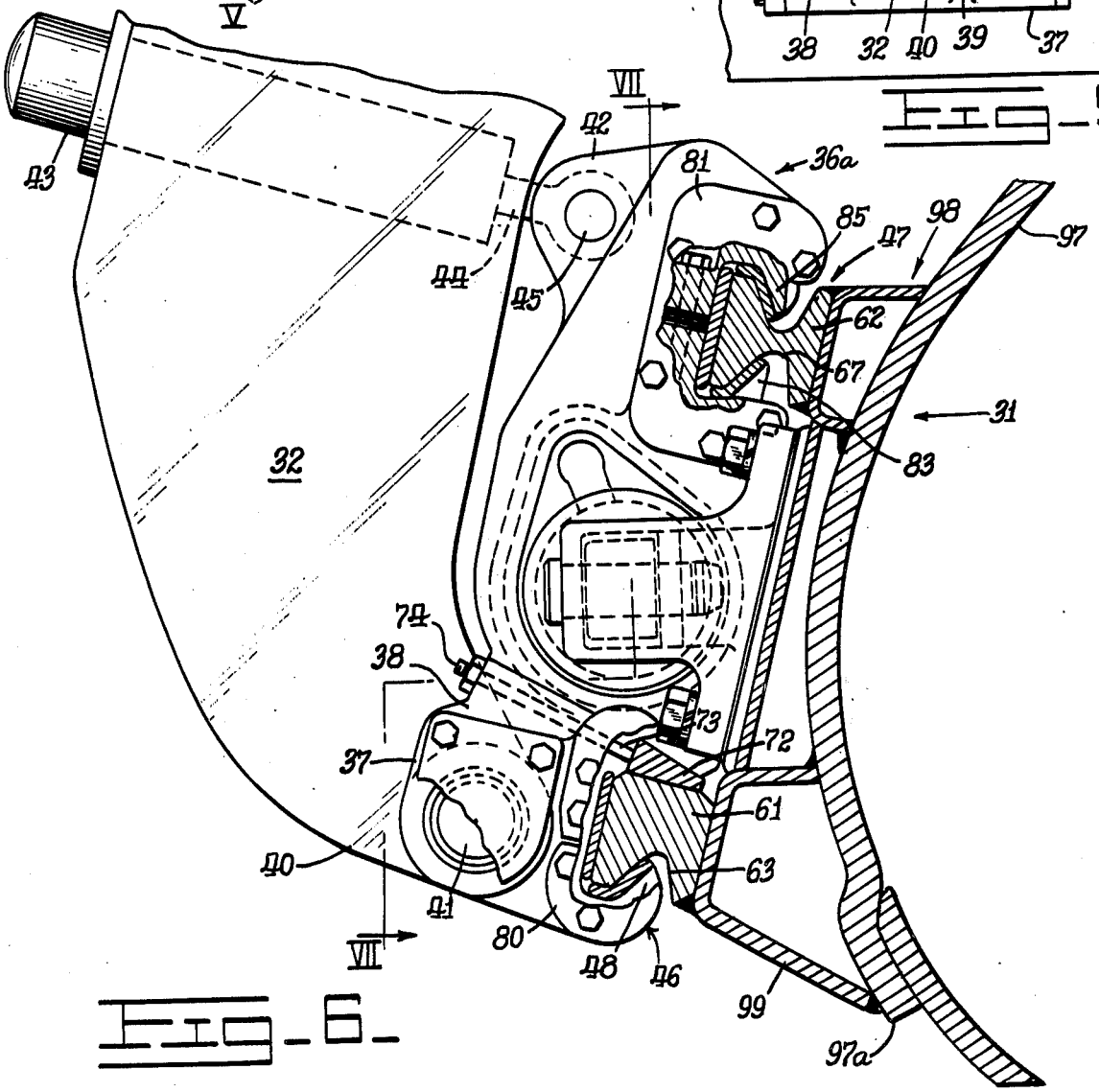
FIG. 6 is a longitudinal sectional view on an enlarged scale, with parts broken away, taken substantially as indicated along the line VI—VI of FIG. 4.
Figure 4:
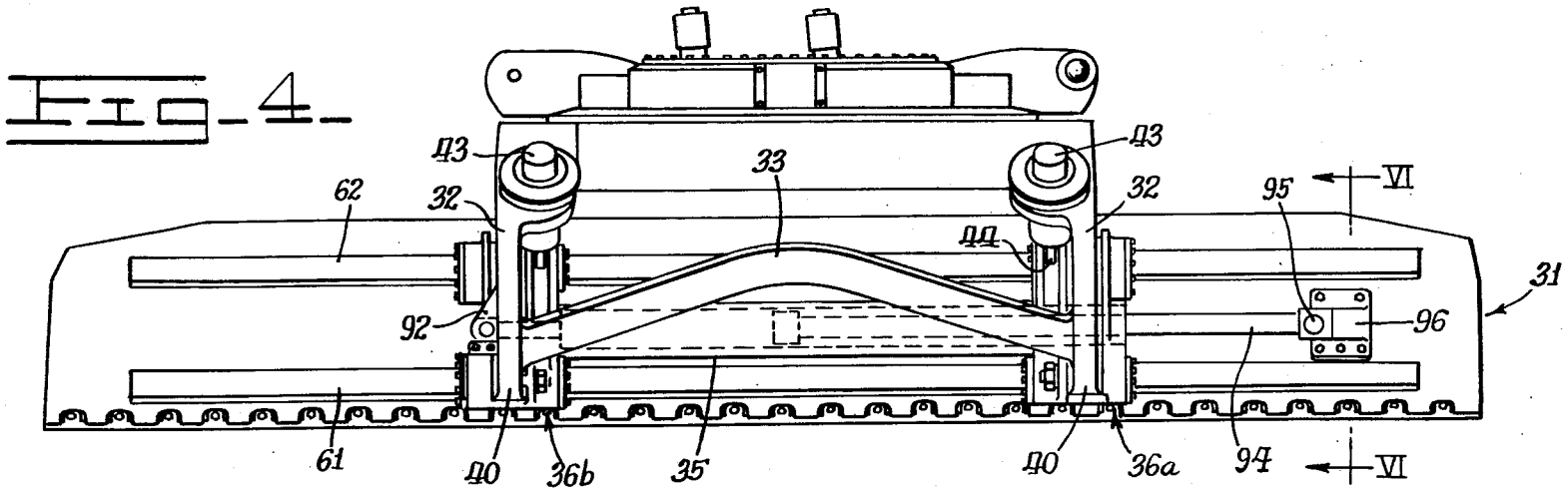
FIG. 4 is a rear elevational view of the apparatus on an enlarged scale, with the blade assembly in a first position.

As best seen in FIGS. 5 and 6 each housing includes a frame 37 which is substantially wider than the support arm 32, and the lower portion 38 of the frame 37 is bifurcated as seen at 39 so as to straddle the lower end portion 40 of the support arm 32; and a pivot pin 41 impales the bifurcated part of the body 37 and the straddled lower end portion 40 of the support arm 32 so that the housing structure 34 is pivoted on the arms 32 and is forward of said arms.

At the upper, rear portions of the housings 36 are parallel webs 42, and hydraulic cylinder units 43 which are mounted upon the support arms 32 have piston rods 44 which extend between the webs 42 and are pivotally connected thereto by pins 45, so that operation of the hydraulic cylinder units 43 swings the bearing housing structure 34 about the pivot pins 41.

Referring now to FIGS. 6, 8 and 9, each of the bearing housings 36*a* and 36*b* has in the forward part of its lower portion 37 a forwardly open fixed lower jaw, indicated generally at 46; and in the upper portion of each housing is a forwardly open fixed upper jaw, indicated generally at 47. Each of the lower jaws is defined by a lower front web 48 which has an inclined inner surface 49; a vertical back surface 50; and extending forwardly and downwardly from the upper end of the back surface 50 is an inclined surface 51 of a top portion 52 of said lower jaw.

The upper jaw 47 is defined by a front lower web 53 which has a vertical rear face 54; a vertical rear surface 55 which is interrupted by an intermediate recess 56; a forwardly extending top jaw surface 57; and a depending front upper web 58 that has a vertical rear surface 59 aligned with the vertical surface 54 of the bottom web 53. Thus, the surfaces 54 and 59 provide a discontinuous guide which is parallel to the surfaces 55; and a wear strip carrier, indicated generally at 60, is slidably mounted in each of said upper jaws 47 between the surfaces 54–59 and the surface 55.

The grader blade assembly 31 has a moldboard 97 and reinforcing means defining a box-like structure 98 which has a bottom web 99 close to the bottom 97*a* of the moldboard. A support rail 61 directly behind the web 99 fits loosely in the lower jaw 46, and has a longitudinal bottom channel 63, a planar back surface 64, and a planar top surface 65 which cooperates with the surface 51 of the lower jaw top portion 52 to define a cavity 66 which is substantially shallower from top to bottom at the front than it is at the rear.

An upper support rail 62 which fits loosely in the carrier 60 has a longitudinal bottom channel 67 which is identical with the channel 63 in the rail 61, and it also has a planar rear face 68 and a top channel 69 which is opposite to and identical with the channel 67.

Anti-friction wear strips line the lower jaw 46, and include a bottom wear strip 70 which seats against the rear surface 49 of the lower front web 48, and also against the bottom of the jaw, and a rear wear strip 71 fills the space between the planar rear jaw surface 50 and the planar rear support rail surface 64. Finally, a wedge shaped wear block 72 is mounted in the cavity 66, and an adjusting stud 73 is carried in a bore in the rear portion of the housing member 36*a* and has a threaded outer end portion 74 which threadedly engages a captive nut 75 mounted in the housing so that the stud may be adjusted longitudinally and thus change the position of the wear block 72 as necessary to maintain a close sliding fit of the lower support rail 61 in the wear strips and the wear block.

Mounted in the wear strip carrier 60 are a lower wear strip 76, an upper wear strip 77, and a back wear strip 78; and in order to maintain a snug sliding fit of the upper support rail 62 in the wear strips 76, 77 and 78 the wear strip carrier 60 consists of a lower part 60*a* and an upper part 60*b*, plus a set of shims 60*c* and assembly bolts and nuts 79 which impale the two parts of the wear strip carrier and the shims.

All of the wear strips are preferably of Teflon or some other very low friction plastic material which requires no lubrication. Before the grader blade is mounted, the upper wear strip carriers 60 with their wear strips 76, 77 and 78 are mounted upon the upper support rail 62; and the wear strips 70 and 71 of the lower jaws 46 are set in the jaws and are lightly secured with adhesive. The grader blade is then moved endwise to position its lower support rail 61 as seen in FIG. 8 and to position the upper support rail 62 and the wear strip carrier 60 as seen in FIG. 9. The wedge shaped block 72 is then moved endwise into the cavity 66 and the adjusting stud 73 is adjusted inwardly until there is a close sliding fit of the bottom support rail 61 in the lower jaw wear strips. Retainer plates 80 which loosely embrace the rearward portion of the bottom support rail 61, and top retainer plates 81 which loosely embrace the rearward portion of the top support rail 62 are then fastened to the housings 37 by means of machine screws which threadedly engage bores that surround the lower jaws and the upper jaws.

As is apparent from FIG. 9, the upper wear strip carriers 60 are free to slide up and down in the upper jaws 47, and this permits free lateral adjustment of the grader blade assembly even if the lower support rail 61 and the upper support rail 62 are not absolutely parallel. This is an important feature of the structure, since it is extremely difficult to achieve perfect parallelism when mounting a pair of rails which must be welded in place.

Referring now to FIGS. 8 and 9, it is seen that the wear strip carrier 60 has a lower front flange 83 with an inclined rear face 84 so that the lower portion of the carrier is just like the lower portion of the lower jaw 46, and respective inclined faces **63*a* of the lower rail bottom channel 63 and 67*a* of the upper rail bottom channel 67 are complementary to the surfaces 49 and 84. In addition, the wear strip carrier 60 also has an upper front flange 85 which has an inclined rear face 86, and the upper rail top channel 69 has an inclined face 69*a* which is complementary to said face 86. Thus, the wear strips 70 and 71 and the wear block 72 essentially envelop the lower rail 61, and the wear strips 76, 77 and 78 essentially envelop the upper rail 62. This, combined with the large lateral span of the bearing housings 36*a* and 36*b*, provides for relatively very low bearing pressures between the rails, the wear strips and the lower jaw 46 and the upper jaw 47 and carrier 60**, thus permitting the use of plastic wear strips which can tolerate only limited bearing pressures.

Figure 7:
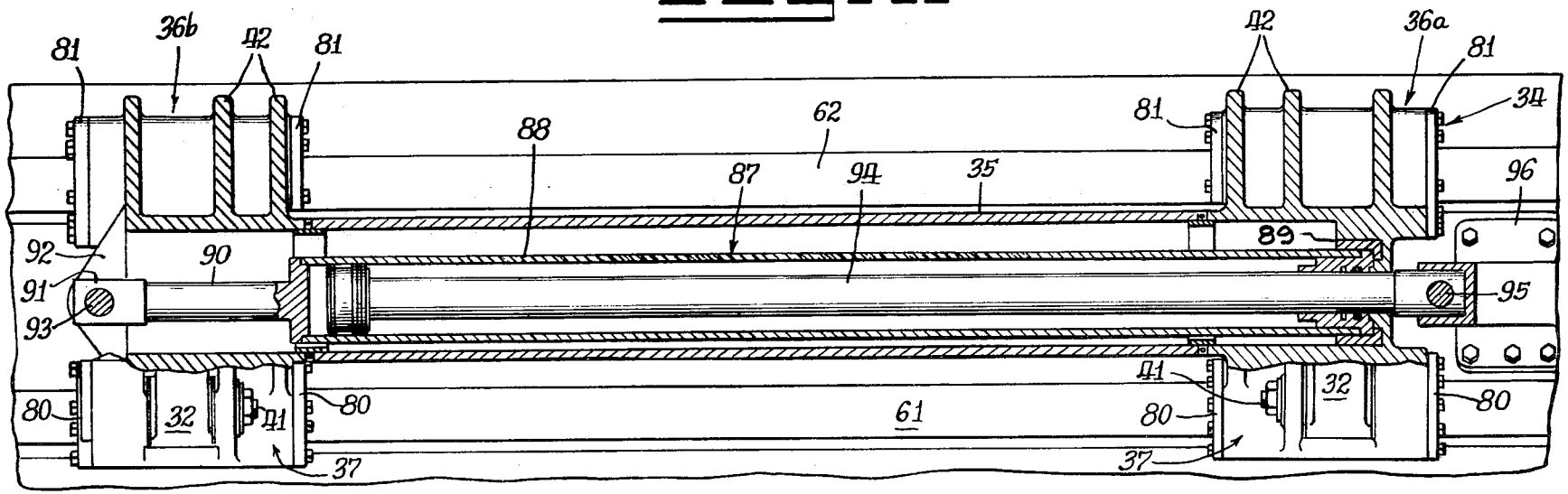
FIG. 7 is a fragmentary sectional view on a reduced scale taken substantially as indicated along the line VII—VII of FIG. 6 with the blade assembly shifted to the left as compared with FIG. 4.

Referring now particularly to FIG. 7, it is seen that the hollow, longitudinal structural member 35 provides a housing for a cylinder and piston unit, indicated generally at 87, by means of which the grader blade assembly 31 is adjusted endwise in the support arms 32 and bearing housings **36*a* and 36*b*. A cylinder 88 of the unit 87 has a forward end carried in a flanged collar 89 that seats in a recess in the bearing housing 36*a*; while the rear of the cylinder 88 is provided with a mounting stud 90 having an outer end portion 91 that is positioned between a pair of spaced, parallel webs 92 that are integral with the housing 36*b*, so that a pin 93 may be used to secure the end of the unit 87. The space between the webs 92 is greater than the maximum diameter of the cylinder 88. A piston rod 94 of the unit 87 has a pin 95 at its outer end by means of which it is pivotally connected to a bracket 96 on the back of the grader blade assembly 31. Thus, when pressure is applied to the head end of the rod 94 the rod is moved from the position of FIG. 7 to the position of FIG. 4 and thus slides the grader blade assembly 31** to the right as seen in those views.

Mounting the cylinder and piston unit 87 in the hollow structural member 35 protects it from damage, and yet the entire unit is easily removed for replacement or repair by removing the pins 93 and 95 and sliding the unit endwise between the webs 92.

The foregoing detailed description is given for clearness of understanding only and no unnecessary limitations should be understood therefrom as modifications will be obvious to those skilled in the art.

What is claimed is:

1. In a motor grader which has a circle with a pair of integral, depending blade support arms at its rearward portion, an improved support and bearing means for mounting a grader blade assembly on said arms for endwise movement, said improved means comprising, in combination:

two generally upright bearing housings each of which is mounted on one of the support arms and forward of said arm, said housing having aligned forwardly open upper jaws and forwardly open lower jaws extending entirely across them;

replaceable anti-friction wear strips lining the interiors of said jaws;

substantially parallel upper and lower support rails on the rear of the blade assembly which extend through said jaws and are slidable in said wear strips, said jaws and support rails having spaced complementary surfaces with wear strips between them which retain the support rails in the jaws;

a downwardly facing surface at the top of each lower jaw and a top surface of the lower support rail which cooperate to define a cavity which is shallower at the front than at the rear;

generally wedge shaped top wear strips which are complementary to said cavities and mounted therein;

adjusting means bearing on the rear of each of said top wear strips to move them forwardly in said cavities for the purpose of maintaining a snug sliding fit between the lower rail and all the wear strips in the lower jaw;

and means for retaining the wear strips in the upper and lower jaws.

2. The combination of claim 1 in which the lower support rail has a planar upper surface.

3. In a motor grader which has a circle with a pair of integral, depending blade support arms at its rearward portion, an improved support and bearing means for mounting a grader blade assembly on said arms for endwise movement, said improved means comprising, in combination:

two generally upright bearing housings each of which is mounted on one of the support arms and forward of said arm, said housings having aligned forwardly open upper jaws and forwardly open lower jaws extending entirely across them;

a wear strip carrier means mounted in each upper jaw for vertical sliding movement, each said carrier means comprising a top member and a bottom member which have confining surfaces, and means for adjusting the vertical span across said confining surfaces;

replaceable anti-friction wear strips lining the interiors of said lower jaws;

replaceable anti-friction wear strips lining the confining surfaces of the wear strip carrier means;

substantially parallel upper and lower support rails on the rear of the blade assembly which extend through said jaws and are slidably confined in said wear strips, said lower jaws having front flanges and said carrier means having front webs which are complementary to support rail surfaces to retain the support rails in the jaws, and there being wear strips between said flanges and webs and the complementary support rail surfaces;

and means to retain the wear strips in the lower jaws and in the wear strip carrier means.

4. The combination of claim 3 in which each lower jaw has a top wear strip between an upper surface of the lower support rail and the upper part of said lower jaw, and in which adjusting means is operatively associated with each lower jaw to move the top wear strip for the purpose of maintaining a snug sliding fit between said lower rail and all the wear strips in the lower jaw.

5. The combination of claim 4 in which the upper part of each lower jaw and the upper surface of the lower support rail define a cavity which is shallower at the front than at the rear, the top wear strips are generally wedge shaped and complementary to said cavities, and the adjusting means bears on the rear of each strip to move said top wear strips forwardly in said cavities.

6. The combination of claim 5 in which the lower support rail has a planar upper surface.

7. In a motor grader which has a circle with a pair of integral, depending blade support arms at its rearward portion, an improved support and bearing means for mounting a grader blade assembly on said arms for endwise movement, said improved means comprising, in combination:

two generally upright bearing housings each of which is mounted on one of the support arms and forward of said arm;

aligned forwardly open lower jaws extending entirely across said housings, said lower jaws having generally planar upper surfaces, upright planar rear surfaces, and lower surfaces defining bottom surfaces and upstanding front flanges having upwardly and forwardly inclined inner faces;

aligned forwardly open upper jaws extending entirely across said housings, there being means in said upper jaws defining planar rear surfaces, substantially planar top and bottom surfaces, and upper and lower front webs having inner faces which are forwardly inclined toward their adjacent margins;

replaceable anti-friction wear strips lining the interiors of said lower jaws and of said means in said upper jaws;

substantially parallel upper and lower support rails on the rear of the blade assembly which extend through said means in said upper jaws and through said lower jaws and are slidable in said wear strips, said support rails being substantially concentric with the surfaces of the means in the upper jaws and with all but the top surfaces of the lower jaws;

means surmounting the top surface of the bottom rail to maintain a snug sliding fit between said rail and the wear strips;

and means for retaining the wear strips in the upper and lower jaws.

8. The combination of claim 7 in which the upper surface of each lower jaw and the upper surface of the lower support rail define a cavity which is shallower at the front than at the rear, and said surmounting means comprises top wear strips which are generally wedge shaped and complementary to said cavities, and adjusting means bears on the rear of each strip to move said top wear strips forwardly in said cavities.

9. The combination of claim 8 in which the lower support rail has a planar upper surface.

10. The combination of claim 8 in which the means in the upper jaws comprise wear strip carrier means, each said carrier means comprising a top member and a bottom member which have confining surfaces concentric with the perimeter of the upper support rail, means for adjusting the vertical span across said confining surfaces to provide a snug sliding fit between said upper rail and wear strips held in said carrier means, and said carrier means being vertically slidable in said upper jaws to compensate for lack of parallelism between the upper and lower support rails.

11. The combination of claim 7 in which the means in the upper jaws comprise wear strip carrier means, each said carrier means comprising a top member and a bottom member which have confining surfaces concentric with the perimeter of the upper support rail, means for adjusting the vertical span across said confining surfaces to provide a snug sliding fit between said upper rail and wear strips held in said carrier means, and said carrier means being vertically slidable in said upper jaws to compensate for lack of parallelism between the upper and lower support rails.

* * * * *